US008678105B2

(12) United States Patent
Habele et al.

(10) Patent No.: US 8,678,105 B2
(45) Date of Patent: Mar. 25, 2014

(54) PLUG ARRANGEMENT IN A MACHINE TOOL, IN PARTICULAR A HANDHELD MACHINE TOOL

(75) Inventors: Michael Habele, Waldenbuch (DE); Marcus Schuller, Dettenhausen (DE)

(73) Assignee: Robert Bosch GmbH, Stuttgart (DE)

( * ) Notice: Subject to any disclaimer, the term of this patent is extended or adjusted under 35 U.S.C. 154(b) by 514 days.

(21) Appl. No.: 12/736,500

(22) PCT Filed: Mar. 19, 2009

(86) PCT No.: PCT/EP2009/053230
§ 371 (c)(1),
(2), (4) Date: Oct. 14, 2010

(87) PCT Pub. No.: WO2009/127491
PCT Pub. Date: Oct. 22, 2009

(65) Prior Publication Data

US 2011/0036607 A1 Feb. 17, 2011

(30) Foreign Application Priority Data

Apr. 18, 2008 (DE) ..... 10 2008 001 268

(51) Int. Cl.
*H01R 13/50* (2006.01)

(52) U.S. Cl.
USPC ..... 173/162.2; 173/170; 173/179; 173/217

(58) Field of Classification Search
USPC ..... 173/216, 217, 29, 170, 171, 162.1, 173/162.2, 176, 179; 310/47, 50, 71
See application file for complete search history.

(56) References Cited

U.S. PATENT DOCUMENTS

| | | | | | |
|---|---|---|---|---|---|
| 2,238,696 | A | * | 4/1941 | Hanley | 310/47 |
| 3,012,159 | A | * | 12/1961 | Druesedow | 310/71 |
| 3,336,490 | A | * | 8/1967 | Yelpo et al. | 310/50 |
| 3,484,632 | A | * | 12/1969 | Opalenik et al. | 310/68 R |
| 3,761,774 | A | * | 9/1973 | Laughinghouse et al. | 361/45 |
| 4,241,297 | A | * | 12/1980 | Piber et al. | 318/17 |
| 4,429,243 | A | * | 1/1984 | Crow | 310/71 |
| 4,677,333 | A | * | 6/1987 | Auzolat et al. | 310/239 |
| 4,748,531 | A | * | 5/1988 | Ortiz | 361/24 |
| 4,812,693 | A | * | 3/1989 | Baines | 310/71 |
| 4,851,725 | A | | 7/1989 | Keck | |
| 4,937,307 | A | * | 6/1990 | Chung | 528/76 |
| 4,937,482 | A | * | 6/1990 | Dohogne | 310/71 |
| 5,018,983 | A | * | 5/1991 | Bittel et al. | 439/76.1 |
| 5,681,214 | A | * | 10/1997 | Kleider et al. | 451/358 |

(Continued)

FOREIGN PATENT DOCUMENTS

| | | | |
|---|---|---|---|
| CN | 1138512 | A | 12/1996 |
| CN | 1157202 | A | 8/1997 |

(Continued)

*Primary Examiner* — Scott A. Smith
(74) *Attorney, Agent, or Firm* — Maginot, Moore & Beck

(57) ABSTRACT

A plug arrangement in a machine tool comprises a primary plug part, which is associated with a drive motor, and a secondary plug part. According to the invention the primary and secondary plug parts are assembled to form a common plug part.

9 Claims, 6 Drawing Sheets

(56) References Cited

U.S. PATENT DOCUMENTS

| | | | | |
|---|---|---|---|---|
| 6,464,542 | B1 | 10/2002 | Lee | |
| 6,912,790 | B2 * | 7/2005 | James et al. | 30/392 |
| 7,204,744 | B2 * | 4/2007 | Lamprecht et al. | 451/357 |
| 7,508,103 | B2 * | 3/2009 | Watkins et al. | 310/71 |
| 7,541,706 | B2 * | 6/2009 | Olijnyk et al. | 310/71 |
| 7,588,465 | B2 * | 9/2009 | Habele et al. | 439/620.09 |
| 7,721,818 | B2 * | 5/2010 | Inagawa et al. | 173/162.2 |
| 7,898,131 | B2 * | 3/2011 | Staigl et al. | 310/71 |
| 2007/0264869 | A1 * | 11/2007 | Habele et al. | 439/529 |
| 2008/0022597 | A1 | 1/2008 | Boischio | |

FOREIGN PATENT DOCUMENTS

| | | | |
|---|---|---|---|
| CN | 1636681 | A | 7/2005 |
| CN | 1681626 | A | 10/2005 |
| CN | 1688418 | A | 10/2005 |
| CN | 101075716 | A | 11/2007 |
| DE | 4110474 | A1 | 10/1992 |
| DE | 29601034 | U1 | 3/1996 |
| EP | 1337012 | A1 | 8/2003 |

* cited by examiner

PLUG ARRANGEMENT IN A MACHINE TOOL, IN PARTICULAR A HANDHELD MACHINE TOOL

CROSS-REFERENCE TO RELATED APPLICATION

This application is a 35 USC 371 application of PCT/EP2009/053230 filed on Mar. 19, 2009.

BACKGROUND OF THE INVENTION

1. Field of the Invention

The invention relates to a plug arrangement in a power tool, in particular a hand-held power tool such as an angle grinder, equipped with a primary plug part, which is associated with a drive motor of the power tool, and a secondary plug part, which is associated with another component in the power tool.

2. Description of the Prior Art

There are known electric motor-driven hand-held power tools such as angle grinders that have a housing containing an electric drive motor that drives a tool shaft to which a tool is fastened. The electric drive motor is switched on and off by means of a manual switch that is usually connected via a plug part to an electronic component for controlling the drive motor. For speed control, the electric drive motor can be associated with a speed sensor and the sensor signals that represent the speed are supplied to the electronic component via another plug part.

With power tools of this kind, it is generally desirable to reduce the number of parts, both for cost reasons and to improve durability. In particular, the abrasive dirt particles produced during operation of the tool can penetrate into the housing interior of the power tool, leading on the one hand to an increased friction in the rotating parts and on the other hand, to undesirable bridging of the electrical contacts, which can result in a short circuit. A reduction in the number of parts also reduces the risk of undesirable dirt particles being deposited in the housing.

OBJECT AND ADVANTAGES OF THE INVENTION

The object of the invention is to create a plug arrangement in a power tool, in particular a hand-held power tool, by means of simple structural measures so that without limiting functionality, the number of parts is reduced and the service life is extended.

The plug arrangement according to the invention is used in a power tool, which is in particular a hand-held power tool such as an angle grinder. The power tool has a housing containing a drive motor, in particular an electric drive motor, that is associated with a primary plug part; electric connecting cables are routed between the drive motor and the primary plug part. In addition, a secondary plug part is provided, which is associated with another unit or electrical component of the hand-held power tool; in a preferred embodiment, this unit or electrical component is a speed sensor for determining the motor speed of the drive motor. Electrical cables are also provided between this other unit and the secondary plug part. The primary plug part and the secondary plug part are united to form a combined plug part.

This embodiment has the advantage that the plug arrangement, with the primary plug part and secondary plug part already in the form of a combined plug part, can be inserted into the housing of the power tool and mounted there. Uniting them to form a combined component not only reduces the number of parts, but also facilitates installation since essentially one combined connecting device suffices for mounting the plug part in the housing. In addition, the combined plug part has less surface area to be attacked by deposits of dirt, in particular abrasive dirt particles that are produced during the machining of a work piece.

In addition, it is possible to embody the primary plug part and secondary plug part as separate components that are connected to each other, thus constituting the combined plug part. For example, the secondary plug part can be placed onto the primary plug part by means of a plug connection; it is also conceivable to provide other connecting measures between the primary and secondary plug parts such as gluing, clamps, or the like.

According to an advantageous embodiment, however, the plug part is embodied of one piece so that the primary and secondary plug part have a combined plug housing. This is advantageously composed of plastic and can, for example, be manufactured using injection molding.

The combined plug part in which the primary and secondary plug parts are united can be provided with coding elements that make it possible to uniquely define the installation position of the plug part in the housing. For example, the coding element can be embodied in the form of a coding rib that protrudes from the outside of the combined plug part and in particular, corresponds to an associated coding recess in the housing so that it is only possible to install the combined plug part in the housing if the coding elements on the plug part and housing engage each other. Another possibility for uniquely defining the installation position lies in providing a coding element in the form of a coding pin that protrudes axially from the outside of the plug part and has either a non-round cross-sectional geometry and/or is positioned on the plug part off-center in the transverse or vertical direction.

According to another advantageous embodiment, the primary plug part and secondary plug part, on the same side of the combined plug part, have insertion openings situated above one another, provided either for installation in the housing or for accommodating electric connecting cables.

According to another advantageous embodiment, the housing of the power tool is composed of several parts and in particular, has a handle housing as well as a motor housing for accommodating the drive motor. The combined plug part is preferably situated in the handle housing; the electric connecting cables are routed from the plug part to at least one actuator in the motor housing, in particular to the electric drive motor, and to the additional electric unit, which is preferably embodied in the form of a speed sensor. Between the handle housing and the motor housing, a damping element can be provided to effectively reduce oscillations that are produced by the machining of the work piece and by the switched-on drive motor. The suitably annular damping element preferably has a central opening and a radial slot that extends to the central opening so that the connecting cables between the plug element and the drive motor and speed sensor can be inserted laterally via the radial slot until they reach the central opening in the damping element. Basically, however, it is also possible for the electric connecting cables to span the distance between the plug element and the drive motor and speed sensor on the outside of the damping element.

Other advantages and suitable embodiments can be inferred from the remaining claims, the description of the figures, and the drawings themselves.

BRIEF DESCRIPTION OF THE DRAWINGS

The invention will be described in further detail below in conjunction with the accompanying drawings, in which.

DESCRIPTION OF THE PREFERRED EMBODIMENTS

Figure 1:
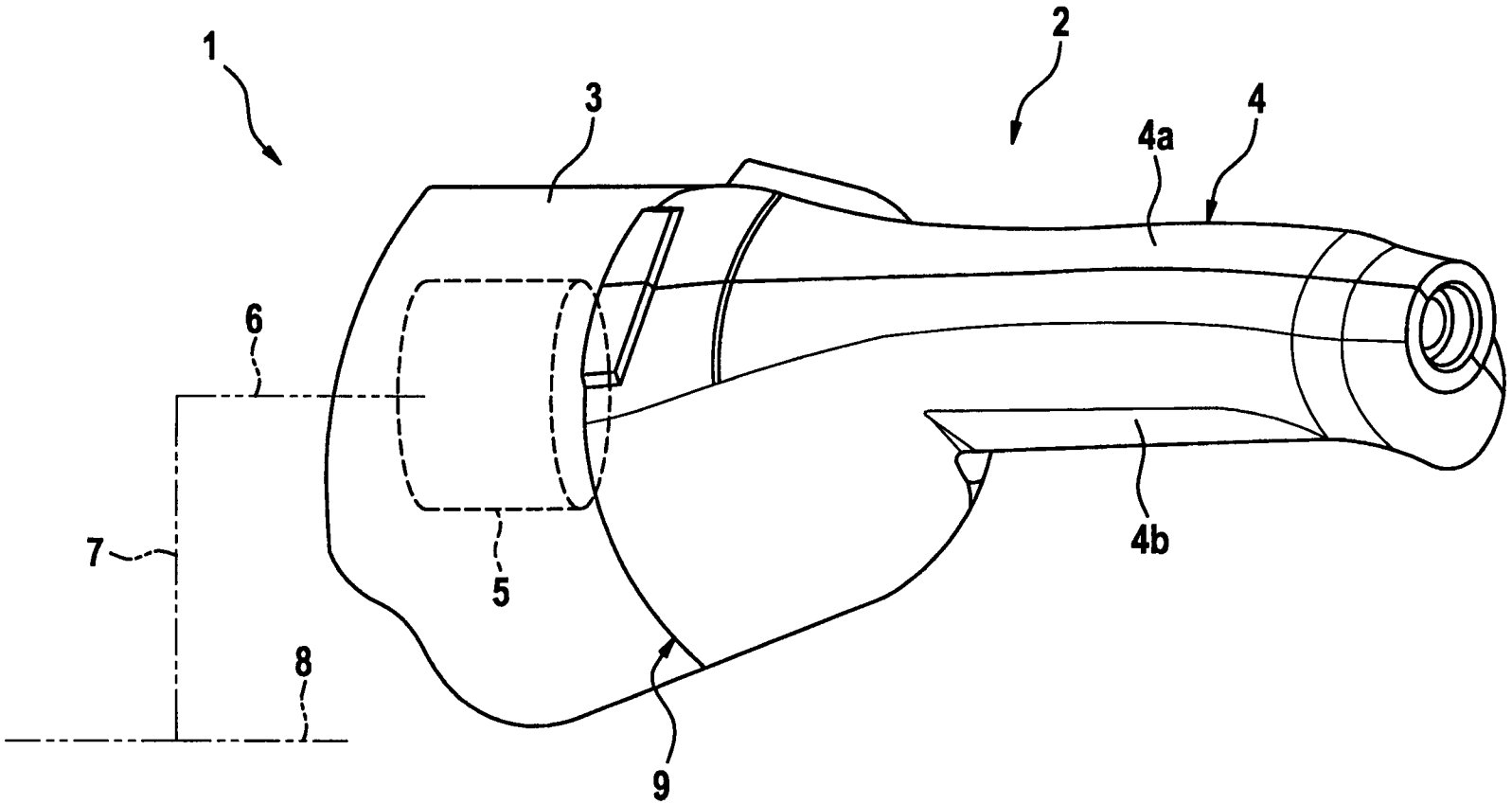
FIG. 1 is a perspective view of a hand-held power tool, having a two-part handle housing and a motor housing for accommodating an electric drive motor.

Components that are the same from one drawing to the next are provided with the same reference numerals.

FIG. 1 schematically depicts a hand-held power tool 1, which is an angle grinder, for example. The housing 2 of the hand-held power tool 1 is composed of several parts and includes a motor housing 3, and a handle housing 4 that is to be connected to the motor housing 4 and is composed of two handle shells 4*a* and 4*b*. The motor housing 3 contains an electric drive motor 5, which, via a drive connection 6, drives a rotatably supported tool shaft 7 that supports a tool 8. The motor housing 3 and handle housing 4 are connected to each other by means of a connecting device 9. An adaptor part, which preferably has a damping element for vibration damping, can optionally be inserted into the region of the connection between the motor housing 3 and handle housing 4.

Figure 2:
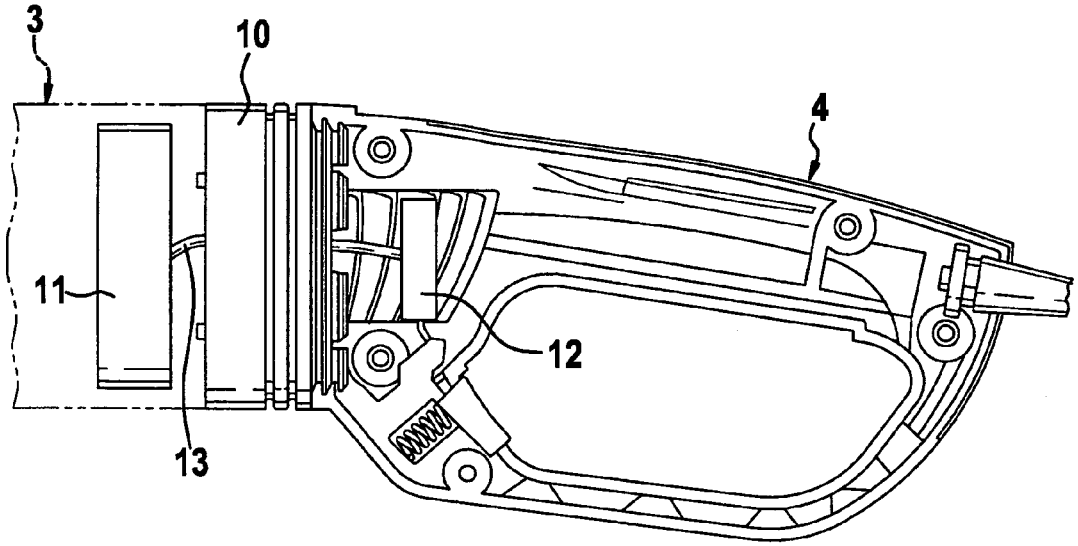
FIG. 2 is a side view of the open handle housing, with a speed sensor that is situated in front of the handle housing and is connected via an electric connecting cable to an electronic component in the handle housing.

FIG. 2 shows such an adaptor part 10 inserted between the motor housing 3 and handle housing 4. The adaptor part 10 is embodied in an annular form and has a central opening through which is routed an electric connecting cable 13 that connects a speed sensor 11 to an electronic component 12. The speed sensor 11 is situated in the motor housing 3 and is associated with the electric drive motor to measure its speed; the electronic component 12 is situated in the handle housing 4.

Figure 3:
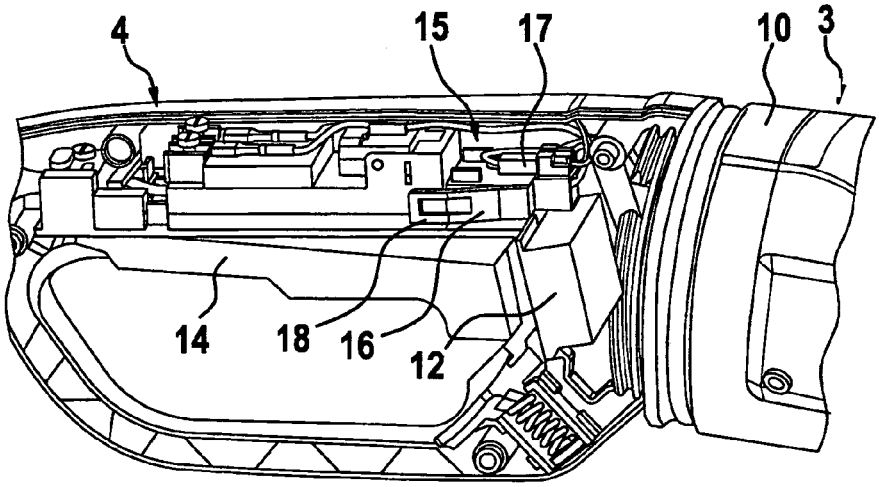
FIG. 3 is a perspective view of the open handle housing, with the electronic component, a manual switch for actuating the electric drive motor, and a plug part composed of a primary and secondary plug.
Figure 4:
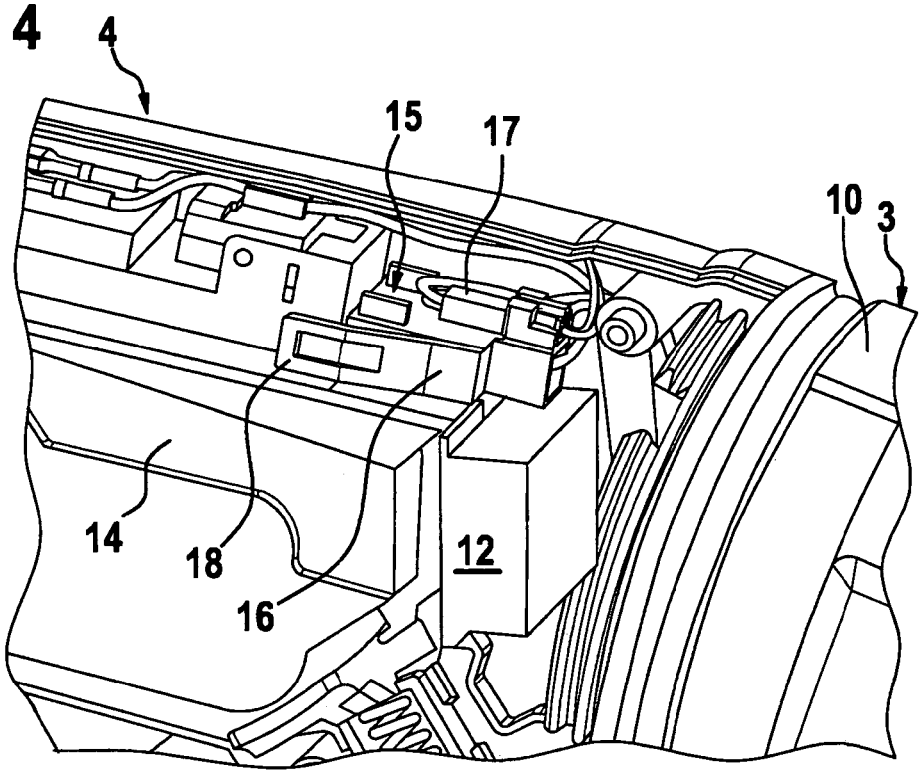
FIG. 4 is a depiction similar to FIG. 3, but from another perspective.
Figure 5:
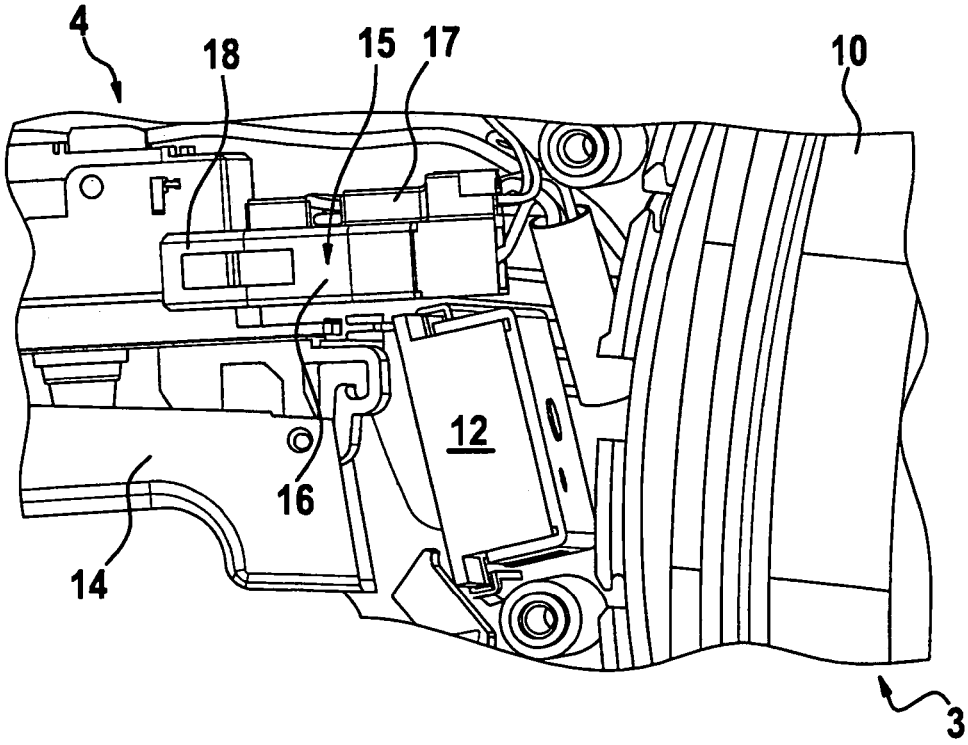
FIG. 5 is another depiction, but from another perspective.

As can be inferred from the various perspectives shown in FIGS. 3 through 5, the handle housing 4 contains a plug part 15 that is composed of two parts and includes a primary plug part 16 and a secondary plug part 17. The primary plug part 16 and secondary plug part 17 are embodied of one piece and have a combined housing that constitutes the plug part 15. The primary plug part 16 is associated with the electric drive motor and the secondary plug part 17 is associated with the speed sensor 11 (FIG. 2). Both plug parts 16, 17 are also connected via electric connecting cables to the electronic component 12 that is situated in the handle housing 4, directly under the plug part 15.

The plug part 15 is situated in the upper section of the handle housing 4, directly above a manual switch 14 for switching the electric drive motor on and off. For fastening and simple installation of the combined plug part 15 in the handle housing 4, the plug part 15 has side walls 18 that protrude laterally from the housing of the plug part and can be bent open in opposition to a spring force acting in the transverse direction. These side walls 18 are each provided with a respective receiving opening that can be slid onto an associated raised area in the handle housing, as a result of which the plug part 15 assumes a detent-engaged position in the handle housing.

Figure 6:
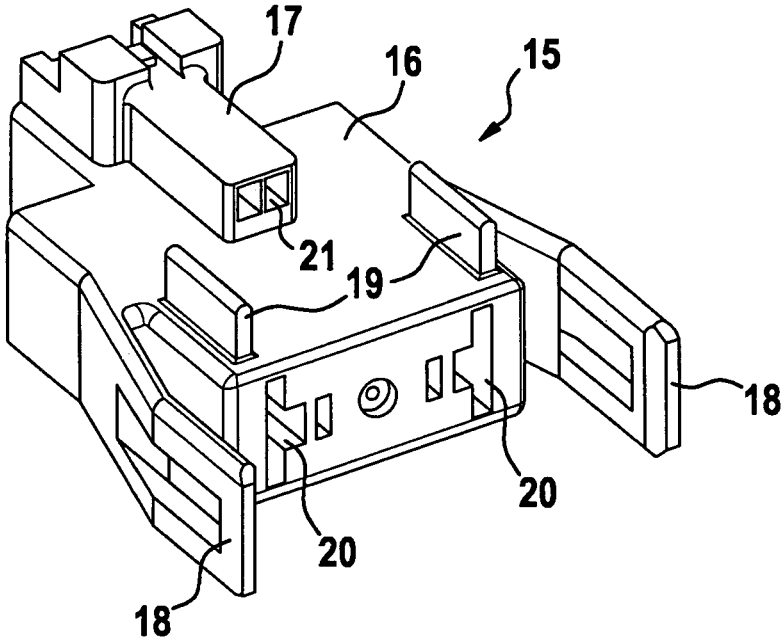
FIG. 6 shows the entire plug part in a perspective detail view.

As can be seen in the detail view of the combined plug part 15 in FIG. 6, the top of the primary plug part 16, on which the secondary plug part 17 is also positioned, has coding ribs 19 that protrude above the wall and are provided to precisely define the installation position of the plug part 15 in the housing of the hand-held power tool. Only a correct installation position prevents the coding ribs 19 from colliding with components in the housing. It can be useful to provide coding recesses in the housing, which are associated with the coding ribs 19 and in which the coding ribs engage in the correct installation position.

The end surface of the primary plug part 16 has insertion openings 20 that are preferably provided for the fastening of the plug part; in the installed position, mounting elements situated in the housing protrude into the insertion openings 20. The insertion openings 20 can optionally also perform the function of accommodating electrical connecting elements. The side walls 18, which are simultaneously used for installing the plug part 15, protrude laterally beyond the end surface of the primary plug part 16 with the insertion openings 20 provided therein.

The secondary plug part 17 is provided with other insertion openings 21 that serve to accommodate electric connecting cables. The insertion openings 21 on the secondary plug part 17 are oriented toward the same end surface as the insertion openings 20 on the primary plug part 16, but the end surface plane of the secondary plug part 17 is offset from the end surface plane of the primary plug part 16.

Figure 7:
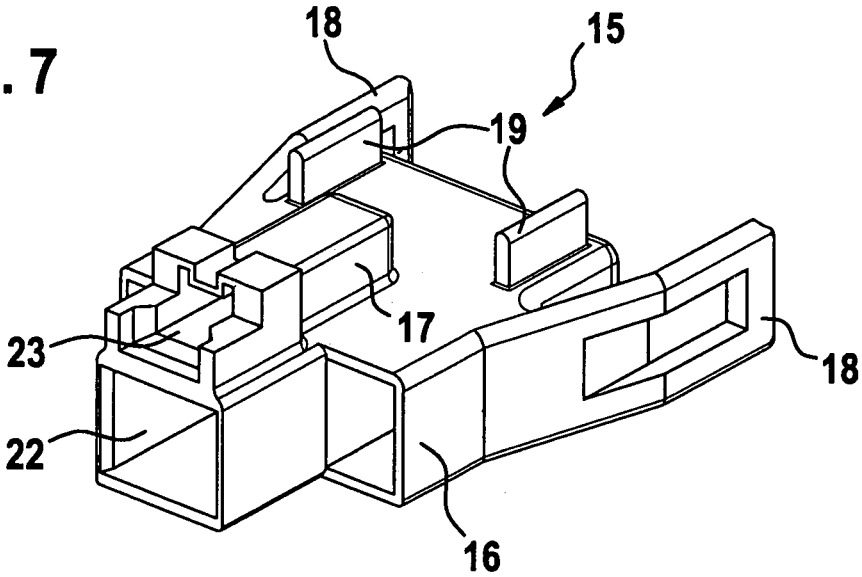
FIG. 7 shows the plug part from another perspective.

As is clear from FIG. 7, other insertion openings 22 and 33, respectively, that serve to accommodate electric connecting cables, are provided in the opposite end surface of the primary plug part 16 and secondary plug part 17, i.e. on the end surface oriented away from the side walls 18.

Figure 8:
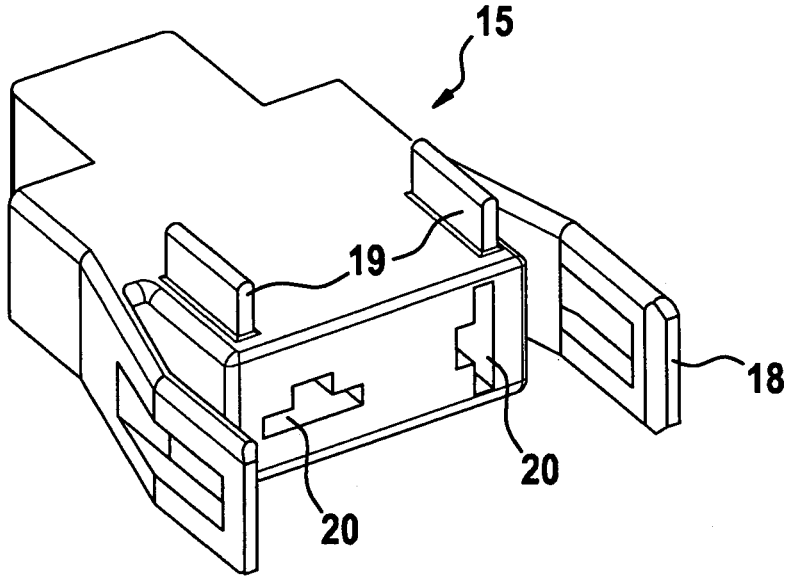
FIG. 8 shows the plug-part with different insertion openings in the end surface, which additionally function as coding elements that define the installation position.

In the exemplary embodiment according to FIG. 8, the end surface of the plug part 15 oriented toward the side walls 18 is provided with two T-shaped insertion openings 20; by contrast with the exemplary embodiment according to FIG. 6, however, these T-shaped insertion openings 20 are not situated mirror-symmetrically to each other, but are instead rotationally offset from each other by 90°. The insertion openings 20 thus likewise function as coding elements, requiring a uniquely defined installation position of the plug part 15 in the housing of the hand-held power tool.

Figure 9:
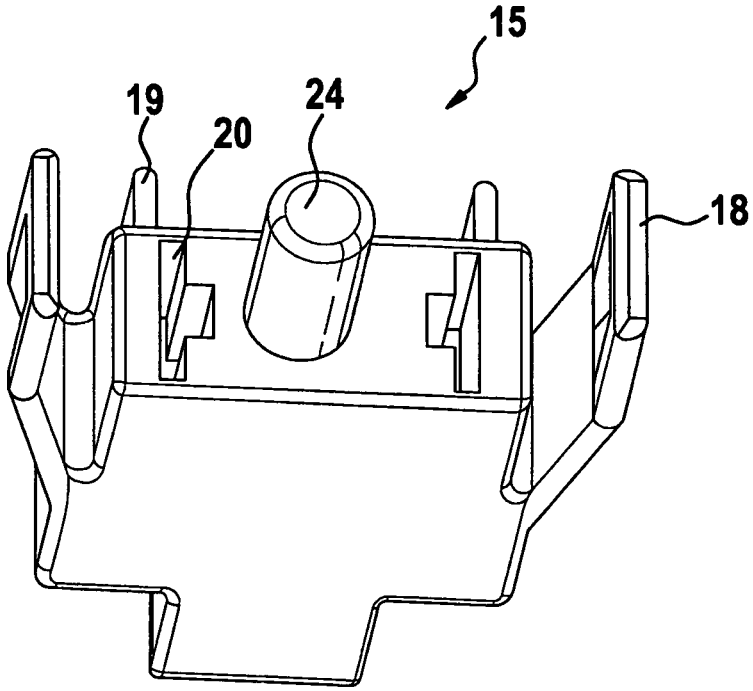
FIG. 9 shows the plug part with a coding pin situated off-center.

In the exemplary embodiment in FIG. 9, the end surface of the combined plug part 15 provided with the insertion openings 20 has a cylindrical coding pin 24 that protrudes axially from the end surface. The coding pin 24 is positioned on the plug part 15, off-center in the transverse direction. This asymmetrical position of the coding pin 24 also assists in establishing a uniquely defined installation position of the plug part 15.

Figure 10:
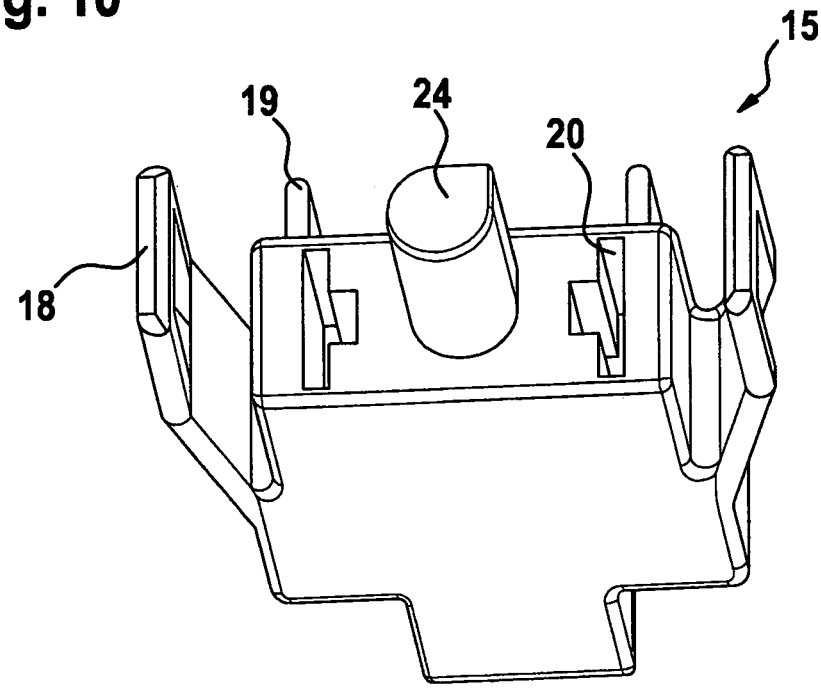
FIG. 10 shows a plug part that has a coding pin with a non-round cross section.

In the exemplary embodiment according to FIG. 10, a coding pin 24 is likewise situated on the end surface of the combined plug part 15 provided with the insertion openings 20. This coding pin 24, however, has a non-round cross-sectional embodiment, in particular an asymmetrical cross section that requires a precisely defined angular position for the installation of the plug part. The coding pin 24 can be positioned either in the center or optionally also off-center in both the transverse and vertical directions.

Figure 11:
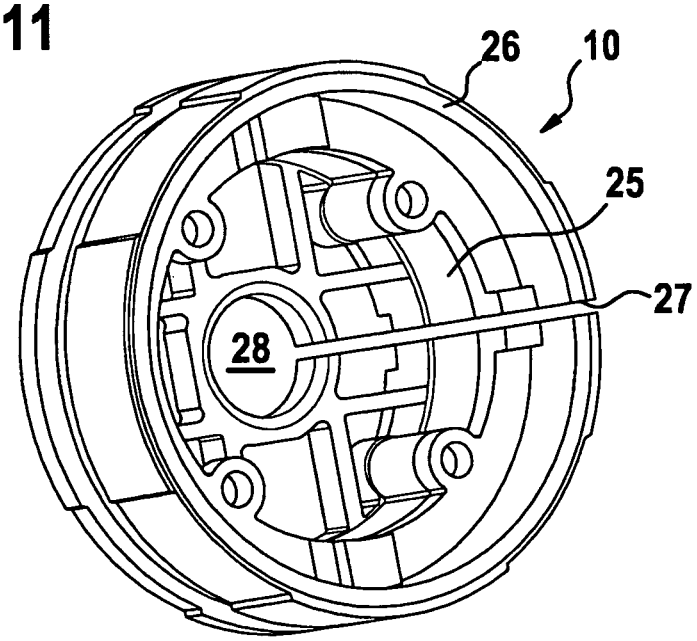
FIG. 11 shows an annular adapter part that includes a damping element for insertion between the motor housing and handle housing; a radial slot extending to a central opening is provided in the adapter part.

FIG. 11, shows an adapter part 10 that can be inserted between the motor housing and handle housing. The adapter part 10 is embodied in an annular form and is composed of a damping element 25 that is secured to an adapter ring 26; the adapter ring 26 is suitably composed of two parts and the damping element 25 is situated between the two parallel adapter ring parts. The adapter part 10 has a radial slot 27 that extends to a central opening 28 through which the electric connecting cables, which extend between the drive motor and speed sensor in the motor housing one the one hand and the electronic component and plug part in the handle housing on the other, are routed inside the handle housing. The radial slot 27 permits the connecting cables to be inserted into the central opening 28 radially from the outside.

The foregoing relates to the preferred exemplary embodiments of the invention, it being understood that other variants and embodiments thereof are possible within the spirit and scope of the invention, the latter being defined by the appended claims.

The invention claimed is:

1. A power tool, comprising:

a motor housing supporting an electric drive motor driving a shaft for engaging a tool and an electrical unit of the power tool separate from the motor;

a handle housing connected to the motor housing;

a plug arrangement disposed within the handle housing and having a primary plug part connected to an electrical connecting cable associated with the drive motor of the power tool and having a secondary plug part connected to an electrical connecting cable associated with the electrical unit of the power tool, the primary plug part and secondary plug part being assembled to form a combined plug part; and a damping element disposed between the handle housing and the motor housing, the damping element having a central opening through which the connecting cables are routed and a radial slot that extends to the central opening.

2. The power tool as recited in claim 1, wherein the combined plug part is embodied of one piece.

3. The power tool as recited in claim 1, wherein the primary plug part and secondary plug part are embodied as separate parts that are connected to each other and constitute the combined plug part.

4. The power tool as recited in claim 1, wherein the combined plug part has a coding element that defines the installation position of the combined plug part within the handle housing.

5. The power tool as recited in claim 4, wherein the coding element is a coding pin that protrudes from outside of the combined plug part.

6. The power tool as recited in claim 4, wherein:

at least one of the primary and secondary plug parts has at least one axially directed insertion opening configured to receive an electrical connecting cable; and the coding element is a coding pin protruding axially from the outside of combined plug part.

7. The power tool as recited in claim 1, wherein the electrical unit with which the secondary plug part is associated is a speed sensor for determining motor speed of the drive motor.

8. The power tool as recited in claim 1, wherein the combined plug part is electrically connected to an electronic component for controlling both the drive motor and the electrical unit with which the secondary plug part is associated.

9. The power tool as recited in claim 1, wherein the primary plug part and the secondary plug part each have insertion openings configured to receive a corresponding electrical connecting cable on a same side of each of the primary plug part and the secondary plug part in which the insertion openings of the primary plug part are situated above the insertion openings of the secondary plug part.

* * * * *